United States Patent [19]

Theurer et al.

[11] 4,417,522

[45] Nov. 29, 1983

[54] MOBIL TRACK CORRECTION MACHINE

[75] Inventors: Josef Theurer, Vienna; Gernot Böck, Aschach, both of Austria

[73] Assignee: Franz Plasser Bahnbaumaschinen Industriegesellschaft m.b.H., Vienna, Austria

[21] Appl. No.: 261,572

[22] Filed: May 7, 1981

[30] Foreign Application Priority Data

Jun. 4, 1980 [AT] Austria ..... 2975/80

[51] Int. Cl.[3] ..... E01B 29/04; E01B 35/00

[52] U.S. Cl. ..... 104/7 B; 246/170; 324/207

[58] Field of Search ..... 104/7 R, 7 A, 7 B, 12, 104/10, 8, 2, 242; 246/167 R, 178, 171, 217, 120, 63 R; 324/217, 207; 340/686; 73/146; 116/202; 248/295.1, 207, 327; 33/287; 51/178

[56] References Cited

U.S. PATENT DOCUMENTS

| | | | |
|---|---|---|---|
| 1,652,127 | 12/1927 | Harbert | 248/295.1 |
| 2,646,557 | 7/1953 | Smith | 116/202 |
| 3,146,727 | 9/1964 | Plasser et al. | 104/7 B |
| 3,943,857 | 3/1976 | Theurer | 104/7 R |
| 4,001,718 | 1/1977 | Wilson et al. | 324/207 |
| 4,046,079 | 9/1977 | Theurer | 104/12 |
| 4,248,154 | 2/1981 | Theurer | 104/7 B |

*Primary Examiner*—Robert B. Reeves
*Assistant Examiner*—Donald Hajec
*Attorney, Agent, or Firm*—Kurt Kelman

[57] ABSTRACT

A mobile track correction machine, which comprises a vertically adjustable tool carrier guided along the track, track lining and lifting tools on the carrier, hydraulic lining and lifting jacks linking the carrier to the machine frame and a control circuit controlling actuation of the jacks and including a switch operable to terminate actuation of the lifting jack, has a safety arrangement for terminating the actuation on disengagement of the tool carrier from the track. The safety arrangement includes an electronic, inductive proximity fuse affixed to the tool carrier and mounted above, and at a nominal distance from the running face of the rail engageable by a respective lifting tool, the proximity fuse being connected to the switch and capable of transmitting an operating signal thereto without touching the running face when the distance between the proximity fuse and the running face is more than the nominal distance.

8 Claims, 4 Drawing Figures

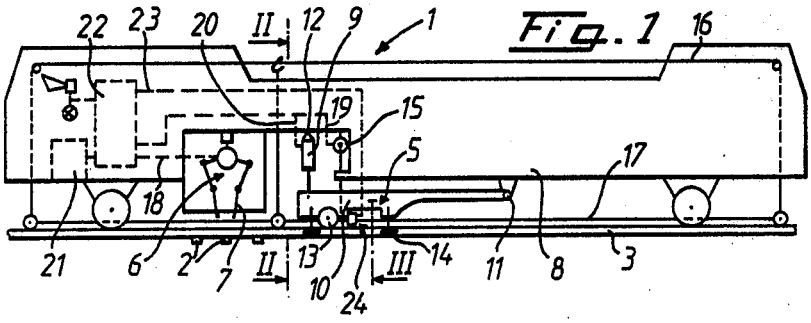
Fig. 1
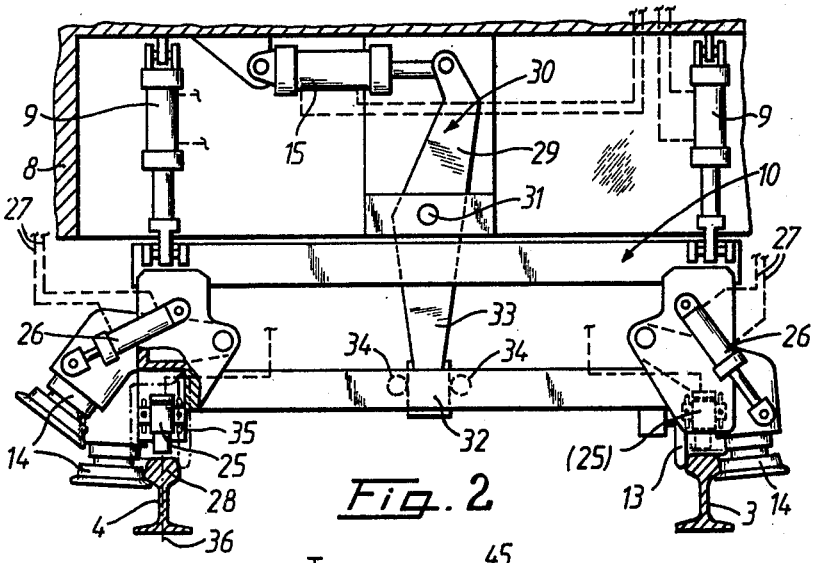
Fig. 2
Fig. 3
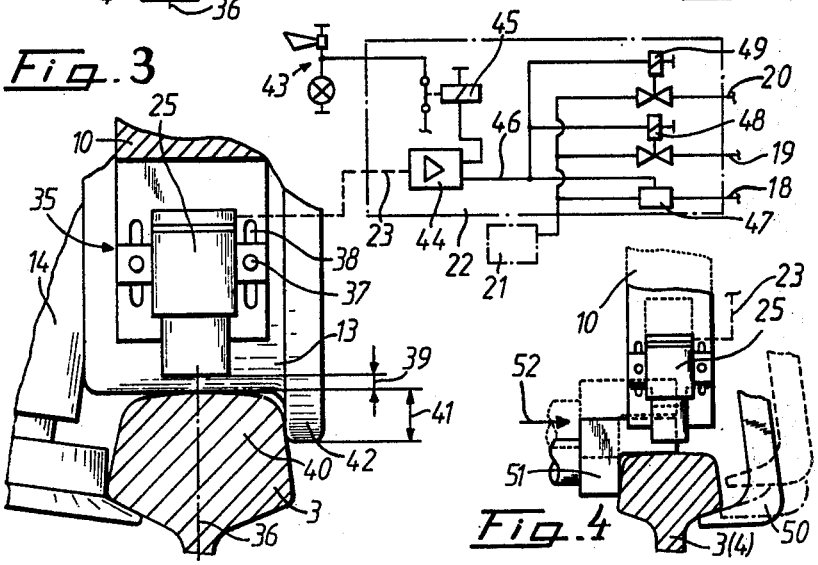
Fig. 4

MOBIL TRACK CORRECTION MACHINE

The present invention relates to a mobile track correction machine, such as a track tamping, leveling and lining machine, mounted for mobility on the rail of the track and comprising a machine frame, a tool carrier mounted on the machine frame for vertical adjustment in relation thereto and for guidance along the track, track lining and lifting tool mounted on the carrier and engageable with the track rails whereby the carrier is engaged with the track, power drive means linking the tool carrier to the machine frames, the power driven means including a lining drive and a lifting drive, and a control circuit controlling actuation of the power drive means and including a switching element operable to terminate actuation of the lifting drive.

U.S. Pat. No. 4,046,079, dated Sept. 6, 1977, disclosed a mobile ballast compacting machine which comprises a tool carrier with tools designed to press the track down to a desired level. A sensing element operating as a mechanical limit switch senses the running face of a rail in the range of the rear undercarriage so as to interrupt excessive downwrd pressure which may lift the machine frame off the track and cause derailment.

Such limit switches operating upon contact with the rail head are also known in safety arrangements in track tamping, leveling and lining machines. Proper and accurate leveling of the track with the lifting tools of such machines requires the tools always to be in full engagement with the track rails during the leveling operation. The safety switch arranged at the rail head in the range of the lifting tool has the purpose of stopping the lifting drive if the lifting tool slips off one rail. Otherwise, the superelevation of the track would be changed if the lifting tool at the other rail remained in engagement and lifting continued. Furthermore, the entire track correction apparatus may be damaged in such an emergency and/or the tool carrier of the apparatus may be derailed. However, the delay between the lifting tools and the lifting drive usually present when the lifting drive is switched on and off sometimes leads to a lag in the responsiveness of the safety switch.

U.S. Pat. No. 3,146,727, dated Sept. 1, 1964, discloses an automatic control device for track tamping machines equipped with a mechanism for lifting the track to a desired level. A control circuit controls actuation of the power drive means for the lifting tools and includes a switching element operable to terminate actuation of the lifting drive. A switch controlled by the downward movement of the tamping tool carrier permits actuation of the track lifting mechanism only when the tamping tools have reached a predetermined depth. The mechanical limit switches again may cause unacceptable delays in stopping operations when the lifting tool slips off the rail.

It is the primary object of this invention to improve the safety arrangement of a mobile track correction machine of the first indicated type by making it more responsive so that the lifting drive and preferably also the lining drive may be stopped instantly upon disengagement of the tool carrier from the track, thus avoiding damage to the track correction apparatus and possible derailment of its tool carrier.

The above and other objects are unexpectedly simply accomplished according to the invention with a safety arrangement including an electronic, inductive fuse affixed to the tool carrier and mounted above, and at a nominal distance from, the running face of the rail engageable by a respective lifting tool. The proximity fuse is connected to the switching element of the control circuit and is capable of transmitting an operating signal thereto without touching the running face when the distance between the proximity fuse and the running face is more than the nominal distance.

Proximity fuses of this type are known, such as the two-wire proximity fuses according to DIN 19234 (German Industrial Standard) or such proximity fuses for direct current. Despite the usual plays encountered with track lifting and lining tools, such proximity fuses will respond rapidly, their response time being readily controlled by setting a desired nominal distance between the rail head and the proximity fuse. They also assure dependable and instantaneous termination of the power drive actuation when only one of the tools slips. This may occur particularly in switch tamping, leveling and lining machines which use all sorts of lifting tools for engaging the rail head or foot and whose engagement with structural track parts in the switch area involves complex tool movements. The prompt interruption of the lifting and/or lining drive operation in case of malfunction of the rail engaging tools also avoids the otherwise required repeated lowering and centering of the tool carrier. The continuing trouble-free operation assured by the safety arrangement of the present invention produces an overall improvement in the accuracy of the track correction operation.

The above and other objects, advantages and features of the present invention will become more apparent from the following detailed description of now preferred embodiments thereof, taking in conjunction with the somewhat schematic drawing wherein FIG. 1 is a side elevation view of a mobile track tamping, leveling and lining machine incorporating the safety arrangement of this invention;

FIG. 2 is an enlarged transverse section along line II—II of FIG. 1;

FIG. 3 is a further enlarged section along line III—III of FIG. 1, illustrating the proximity fuse in association with the lining and lifting tools engaged with one of the rails; and FIG. 4 is a similar view showing another type of lining and lifting tools.

Referring now to the drawing and first to FIG. 1, there is shown mobile track correction machine 1 illustrated as a track tamping, leveling and lining machine comprising machine frame 8 mounted for mobility on track rails 3, 4 fastened to ties 2. Tool carrier 10 of track correction apparatus 5 is mounted on machine frame 8 for vertical adjustment in relation thereto and for guidance along the track. Furthermore, tamping unit 6 carrying ballast tamping tools 7 is also vertically adjustably mounted on the machine frame. Power drive means illustrated as hydraulic jacks link tool carrier 10 to machine frame 8, the power drive means including lining drive 15 and lifting drive 9. Universal joint 11 connects one end of tool carrier 10 to machine frame 8 while its other end is linked to the machine frame by universal joint 12 which connects lifting jack 12 to the machine frame. Track lining and lifting tools 13, 14 are mounted on carrier 10 and are engageable with track rails 3, 4 whereby the carrier is engaged with the track. In the embodiment of FIGS. 1-3, the lining tools are flanged wheels 13 including flanges 42 engageable with the gage sides of the track rails and projecting distance 41 below the running faces of the rails. These lining tools simultaneously serve to guide tool carrier 10 along the track and are arranged in the same transverse plane for engagement with the respective rails. The lifting tools 14 are two flanged rollers associated with each track rail, each flanged wheel 13 being arranged intermediate the two flanged rollers and these flanged rollers being rotatable about substantially vertical axes so that the flanges subtend heads 40 of the rails. When the lining and lifting tools engage the track rails and power drive means 9, 15 are selectively actuated, the track position may be corrected in relation to leveling reference line 16 and/or lining reference line 17 of a generally conventional reference system.

The power drive means for the tool carrier as well as for operating the tamping unit, i.e. reciprocating and vibrating tamping tools 7, are hydraulically operated in the illustrated embodiment. For this purpose, the power source carried by machine frame 8 includes source 21 of hydraulic fluid and conduits 18, 19 and 20 connect the hydraulic fluid source respectively to tamping unit 6, lining drive 15 and lifting drive 9. Control circuit 22 operated from an operator's cab on machine frame 8 controls the actuation of the power drive means (see FIG. 3) by regulating the flow of hydraulic fluid from source 21 to the respective drives through the connecting conduits.

The safety arrangement for terminating the actuation on disengagement of tool carrier 10 from the track includes electronic, inductive proximity fuse 25 affixed to carrier 10 and mounted above, and at nominal distance 39 from, the running face of the rail engageable by respective lifting tool 14. Signal transmission line 23 connects the proximity fuse to switching element 49 operable to terminate actuation of lifting drive 9 as well as to switching element 48 operable to terminate actuation of lining drive 15, to control 47 operating tamping unit 6 and to switching element 45 operating warning signal emitter 43, as will be described hereinafter. Proximity fuse 25 is capable of transmitting an operating signal to switching elements 45, 48 and 49 as well as to control 47 without touching the running face of rail head 40 when the distance between the proximity fuse and the running face is more than nominal distance 41. This distance is preferably at least 10 mm, which has proved to be very effective with the use of lifting hooks and like lifting tools subtending a rail head for lifting the rail. When the lining tools are flanged wheels, nominal distance 41 of the proximity fuse is less than distance 41 by which flange 42 projects below the running face. Thus, if the lifting tool should slip during the lifting operation and the tool carrier thus becomes disengaged from the track, the operating signal from proximity fuse 25 will terminate actuation of the power drive means before flange 42 is lifted to the level of the running face, which could cause derailment of tool carrier 10. Such a slippage of a lifting tool is particularly harmful in the illustrated embodiment because, unless the lifting drive is stopped in time while one of the two lifting tools still remains engaged with the rail and thus continues to lift the carrier, serious damage may be done by the bending forces exerted upon the tool carrier.

As shown in FIG. 2, a respective proximity fuse is positioned in vertical plane of symmetry 36 of each rail 3, 4. Each lifting tool 14 is a flanged roller pivotally mounted on a bracket on tool carrier 10 and pivotal into and out of subtending engagement with respective rail head 28 by hydraulic jack 26 whose cylinder chambers are connected to hydraulic fluid source 21 by conduits 27. Using two lifting tools for each rail has the advantage of counteracting bending of the rail during the lifting operation and, in addition, one or the other lifting tool may be pivoted out of engagement with the rail head at a double-tie where structural parts prevent engagement of the rail head by the lifting tool. Such pivoting is illustrated at the left side of FIG. 2 with respect to one of the lifting tools.

One end of lining jack 15 is linked to a bracket on machine frame 8 while its other end is linked to upper arm 29 of two-armed force-transmitting lever 30. This lever is pivoted on machine frame 8 for reciprocation about horizontal pivot axis 31 extending in the direction of machine elongation for pivoting in a vertical plane extending transversely to the track. End 32 of lower lever arm 33 is glindingly engaged between a pair of entrainment elements 34 constituted by two bolts projecting from a transverse beam of tool carrier 10. Upon actuation of drive 15, lever 30 will be pivoted and move the tool carrier with the track engaged thereby to the right or left.

Mechanism 35 vertically adjustably mounts proximity fuse 25 on tool carrier 10, the mechanism illustrated in FIG. 3 comprising a mounting defining vertical guide slots 38 and set screw 37 engaging the guide slots for holding the proximity fuse at a selected nominal distance from the rail head. In this manner, the nominal distance of the proximity fuse from the rail head during engagement of the rails by the lifting and lining tools may be predetermined. For a better understanding, proximity fuse 25 associated with rail 4 is shown in full lines while the flanged wheel lining tool is shown in chain-dotted lines. At rail 3, flanged wheel 13 is shown in full lines and covers the proximity fuse shown in broken lines, according to line II—II of FIG. 1.

The vertically adjustable mounting of the proximity fuses makes it possible to adjust the safety factor to any desired degree to assure safe operations under given operating conditions.

It will be useful to mount warning signal emitter 43 in the operator's cab on the machine frame, the warning signal emitter being connected to control circuit 22 and arranged to emit an optical or acoustic warning signal when the proximity fuse transmits the operating signal to switching element 45. This enables the operator to take any required control measures warranted by the disengagement of the tool carrier from the lifting tools. Also, since the tamping unit operation is terminated at the same time by the provision of control 47 in control circuit 22, the safety arrangement will also prevent continued tamping under these conditions, which is of particular advantage in complex tamping of ballast in superelevated track sections, in curves and in uphill sections.

FIG. 4 illustrates the safety arrangement including proximity fuse 25 in conjunction with a modified lifting and lining tool structure. This structure comprises lifting hook 50 engageable with the rail head on the field side thereof and cooperating with gliding jaw 51 engaging the gage side of the rail head. The proximity fuse is mounted between the lifting hook and gliding jaw. As will be appreciated from the drawing, such a lifting hook may readily slip off the rail head and, unless the operating signal from proximity fuse 25 promptly terminates further lifting, as assured by the above-described safety arrangement, the tool carrier will raise the lifting hook as well as gliding jaws 51 to a level above the rail head, as shown in broken lines. The lining force would continue to be transmitted in the direction of arrow 52, causing the entire tool carrier to be moved laterally beyond the rail, causing not only possible damage but also uncontrolled lining movements. In this embodiment, it is particularly important to terminate not only actuation of the lifting device but also that of the lining drive.

The operation of the machine will partly be obvious from the above description of its structure and will be summarized hereinbelow.

If lifting tool 14 should become disengaged from the rail head during a leveling operation, lifting drive 9 will momentarily continue to raise tool carrier 10 and proximity fuse 25 affixed thereto. This will increase the distance between the proximity fuse and the associated rail and cause the fuse to transmit an operating signal to switching element 49 to terminate actuation of lifting drive 9. Since normal distance 39 is smaller than distance 41, the lifting drive actuation will be terminated before flange 42 is lifted above the running face of the rail head.

As soon as distance 39 is increased beyond its set nominal value, proximity fuse 25 will emit an operating signal transmitted by line 23 to amplifier 44 and the amplified operating signal will be transmitted from one output of the amplifier to switching elements 45, 48 and 49 while line 46 connects another output of amplifier 44 to control 47. Actuation of the switching elements will cause emitter 43 to emit a warning signal, which may be visible and/or audible, and at the same time hydraulic fluid flow through conduits 19 and 20 will be interrupted to stop lining and lifting drives 15 and 9. Simultaneously, hydraulic fluid flow from source 21 through conduit 18 will also be interrupted to halt the operation of tamping tools 7.

While a specific and now preferred track correction apparatus has been described and illustrated, the safety arrangement of the present invention may be used with any suitable lining and lifting mechanism. Also, the specific arrangement of the proximity fuses as essential part of the safety arrangement of this invention may be modified so that, for example, a proximity fuse is associated with each lifting tool at each rail and, if desired, each lining tool also has a proximity fuse associated therewith. This may be particularly useful if the spacing between the tools is considerable so that the nominal distances at each tool differ considerably.

What is claimed is:

1. A mobile track correction machine mounted for mobility on the rails of the track and comprising (a) a machine frame, (b) a tool carrier mounted on the machine frame for vertical adjustment in relation thereto and for guidance along the track, (c) track lining and lifting tools mounted on the carrier and engageable with the track rails, whereby the carrier is engaged with the track, (d) power drive means linking the tool carrier to the machine frame, the power drive means including (1) a lining drive and (2) a lifting drive, (e) a control circuit controlling actuation of the power drive means and including (1) a switching element operable to terminate actuation of the lifting drive, and (f) a safety arrangement for terminating the actuation on disengagement of the tool carrier from the track, the safety arrangement including (1) an electronic, inductive proximity fuse affixed to the tool carrier and mounted above and at a nominal distance from the running face of a respective rail engageable by a respective lifting tool, the proximity fuse being connected to the switching element and capable of transmitting an operating signal thereto without touching the running face when the distance between the proximity fuse and the running face is more than the nominal distance, and (2) a mechanism for vertically adjustably mounting the proximity fuse on the tool carrier.

2. The mobile track correction machine of claim 1, wherein the nominal distance is at least 10 mm.

3. The mobile track correction machine of claim 1 or 2, wherein the proximity fuse is positioned in the vertical plane of symmetry of the respective rail.

4. The mobile track correction machine of claim 1, wherein the mechanism comprises a mounting defining a vertical guide slot and a set screw engaging the guide slot.

5. The mobile track correction machine of claim 1, wherein the lining tools are flanged wheels including flanges engageable with the gage sides of the track rails and projecting a distance below the running faces of the rails, the nominal distance of the proximity fuse being less than the distance by which the flange projects below the running face.

6. The mobile track correction machine of claim 1 or 5, wherein two of said lifting tools and one of the lining tools intermediate the two lifting tools are associated with each track rail, the proximity fuse between arranged between the two lifting tools approximate the lining tool.

7. The mobile track correction machine of claim 1, further comprising a warning signal emitter connected to the control circuit and arranged to emit a warning signal when the proximity fuse transmits the operating signal to the switching element, the machine frame including an operator's cab and the warning signal emitter being mounted in the cab.

8. The mobile track correction machine of claim 1, further comprising a tamping unit mounted on the machine frame, power drive means for operating the tamping unit and the switching element in the control circuit being operable to terminate actuation of the power drive means operating the tamping unit.

* * * * *